US010210697B1

(12) United States Patent
Giuffria et al.

(10) Patent No.: US 10,210,697 B1
(45) Date of Patent: Feb. 19, 2019

(54) SYSTEM AND DEVICE FOR CONDUCTING GAMES HAVING A WAGERING STAGE AND A NON-WAGERING STAGE

(71) Applicants: Gregg Russell Giuffria, Las Vegas, NV (US); Joseph Baron Giuffria, Las Vegas, NV (US)

(72) Inventors: Gregg Russell Giuffria, Las Vegas, NV (US); Joseph Baron Giuffria, Las Vegas, NV (US)

(73) Assignee: G2 GAME DESIGN, LLC, Las Vegas, NV (US)

( * ) Notice: Subject to any disclaimer, the term of this patent is extended or adjusted under 35 U.S.C. 154(b) by 0 days.

(21) Appl. No.: 14/793,549

(22) Filed: Jul. 7, 2015

(51) Int. Cl.
*G07F 17/32* (2006.01)

(52) U.S. Cl.
CPC ..... *G07F 17/3204* (2013.01); *G07F 17/3244* (2013.01); *G07F 17/3295* (2013.01)

(58) Field of Classification Search
USPC ..... 463/12, 10
See application file for complete search history.

(56) References Cited

U.S. PATENT DOCUMENTS

| | | | | |
|---|---|---|---|---|
| 9,159,202 | B2 | 10/2015 | De Waal et al. | |
| 9,440,152 | B2 * | 9/2016 | Thompson | A63F 13/35 |
| 9,542,799 | B2 | 1/2017 | Washington et al. | |
| 9,875,499 | B2 | 1/2018 | Washington et al. | |
| 9,940,785 | B2 | 4/2018 | Washington et al. | |
| 2011/0183739 | A1 * | 7/2011 | Ansari | G07F 17/32 463/16 |
| 2015/0375117 | A1 * | 12/2015 | Thompson | A63F 13/35 463/9 |
| 2016/0171835 | A1 | 6/2016 | Washington et al. | |

OTHER PUBLICATIONS

Synergy Blue, LLC; U.S. Appl. No. 62/127,821, Entitled: RPG and Sports Themed Hybrid Arcade-Type, Wager-Based Gaming Techniques; Mar. 3, 2015; 96 pages; US.
Synergy Blue, LLC; U.S. Appl. No. 62/091,451, Entitled: Hybrid Arcade-Type, Wager-Based Gaming Techniques; Dec. 12, 2014; 67 pages; US.

* cited by examiner

*Primary Examiner* — Pierre E Elisca
(74) *Attorney, Agent, or Firm* — Greenberg Traurig, LLP

(57) ABSTRACT

A system includes a game device. A non-gambling game including a transition point is conducted on the game device. When a transition point is reached, a gambling game that is logically independent of the non-gambling game is conducted. The gambling game produces a gambling game outcome independent of the non-gambling game.

37 Claims, 2 Drawing Sheets

SYSTEM AND DEVICE FOR CONDUCTING GAMES HAVING A WAGERING STAGE AND A NON-WAGERING STAGE

FIELD OF THE INVENTION

The present invention relates to methods, systems, and devices for computing. More specifically, some embodiments of the present invention relate to methods, systems, and devices for managing and sequencing games on a computing device, such as an electronic gaming device, in which multiple games may be presented.

BACKGROUND OF THE INVENTION

The word "gaming" refers to two different concepts in the entertainment industry. In one context, sometimes referred to as entertainment gaming, the word "gaming" refers to computer or video games in which play is conducted from a gaming console, arcade machine, personal computer, cellular telephone, personal digital assistant ("PDA"), or the like. In entertainment gaming, the player usually exercises skill, logic, strategy, and luck to influence the outcome of the game. Games within the entertainment gaming genre may take many different forms, including games for individuals to compete against a computer-controlled opponent (or a standard, such as a game timer or minimum score), games for individuals to compete against other individuals, games for teams to compete against other teams, or the like. While some games involve some payment, the payment is not a "wager." That is, entertainment games usually require a payment for the purchase or license of the game and/or a payment to play the game in a specific forum, such as specially designated networks or the like. However, such a payment is not in the form of a wager since the payment is typically not staked for participation in the game and typically is not used to determine eligibility for a tangible prize.

Entertainment games may be conducted in single player or multi-player environments with each player playing the game at a separate terminal, such as a personal computer, that communicates with a server coordinating the game. Massively Multi-player Online Games ("MMOG") such as World of Warcraft™ and EverQuest™ are examples of games with multi-player play. Real time simulation ("RTS") games such as Farmville™ and Mafia Wars™ are examples of games with multi-player social interaction. The advent of social networking websites, such as Facebook™, has drawn even more players to games with multi-player play and/or multi-player social interaction.

Many of these entertainment games include elements of skill, strategy, or other player interaction which influences the outcome of the game. The outcome of the entertainment game typically includes a score, level, achievement, or the like, which is usually non-tangible in that it has no value other than bragging rights.

The word "gaming" may also be used to refer to wagering games and gambling games. Regardless of whether the gaming occurs in a physical, brick-and-mortar casino or a virtual, online casino, these types of casino or wagering games usually include three components: a wager, chance, and a reward. That is, casino or wagering games are usually games in which the outcome of a wager, that is, the reward, is determined by chance, which predominates over every other factor, including skill. For example, chance predominates in card games such as poker, blackjack, or the like, even though some skill is involved. Specifically, chance, rather than the player's skill, determines which cards are dealt to the players, which cards are dealt to a dealer, if any, which cards are cut from the deck or shoe of cards, and so forth. In other wagering games, such as reel slot games, numbers games (such as keno, lotto, pull tabs, or the like), dice games, wheel games (such as roulette), or the like, chance is the only factor to determine the outcome of the wagering game, with skill having no influence on the symbols or numbers drawn, rolled, or spun.

As may be appreciated, the outcomes of wagering games can usually be determined by the strict probabilities that govern the games and, therefore, the hold for the game operator over the long term can be predicted. As may further be appreciated, this may not be true for skill games, in which the outcomes would vary from player to player based on the player's skill. As may be appreciated, wagering games must be operated for a profit over the long term and would generally not operate games that allow certain players to improve their performance through practice. Consequently, casinos will not, and in some jurisdictions cannot, offer gambling games in which skill predominates (or even affects) the determination of the outcome of the gambling game.

A well-known consequence of the difference between skill games and chance games is the way in which casinos offer poker games versus how casinos offer house banked games. As may be appreciated, poker, in which skill plays a factor, is typically offered only in a player-banked or parimutuel form. In online poker and other player-banked games, massive volumes of players are required to maintain liquidity. In a player-banked game a player-banker banks the other players' wagers and in a parimutuel game, the players contribute to a pot that is awarded to the winning player(s). While player-banked and parimutuel games are more predictable in the short term because the casino operator does not collect losing wagers and pay winning wagers, the casino operator only collects a small fee for administering and operating the game. This fee is levied regardless of the outcome of the game, so the casino operator makes money on every game. However, because the fee is generally low, the casino operator must generally have a high volume of play to be profitable. Because the online casino only makes a small rake on each poker game, the online casino must ensure that a large volume of players, and hence a large volume of pots to rake, are processed by the site.

Conversely, house-banked games, i.e., those games in which the online casino operator banks wagers by collecting losing wagers and paying winning wagers, are particularly profitable for casinos because the games include a built-in house edge that guarantees the game will be profitable in the long term. However, the win or loss from these games can fluctuate wildly in the short term, such as when a player has a winning streak, and the casino operator must maintain a reserve of cash to pay off all winning bets.

SUMMARY OF THE INVENTION

Embodiments of the present invention include a game device with a game device processor in communication with a game device interface and a random number generator module. The random number generator module may be hardware, software, or firmware. Additionally, the random number generator module may be local to the game device or remote from the game device, such as in a server.

The game device processor executes program instructions. In one optional embodiment, a wager is received through the game device interface. The game device processor conducts a non-gambling game without utilizing the random number generator module. The non-gambling game includes at least one transition point which is reached, at least in part, in response to receiving at least one skill-based player input through the game device interface.

A gambling game is conducted by the game device processor in response to the non-gambling game reaching the transition point. The gambling game utilizes the random number generator module to generate a gambling game outcome. In one optional embodiment, the gambling game may be displayed at the game device. In another optional embodiment, the gambling game may be conducted without being displayed at the game device.

The game device processor determines whether the gambling game outcome is a winning outcome. In one optional embodiment, the determination is made by comparing the gambling game outcome to a predefined schedule of winning outcomes.

A payout is issued through the game device interface when the gambling game outcome is a winning outcome independent of the conduct of the non-gambling game.

In an optional embodiment, a game fee is received through the game device interface for eligibility in the non-gambling game. In such an optional embodiment, the non-gambling game is conducted in response to receipt of the game fee. In one optional embodiment, the game fee may be retained in exchange for play of the non-gambling game. In another optional embodiment, the game fee may be returned In a further optional embodiment, a non-gambling game outcome is generated based, at least in part, on the skill-based player input. In such an optional embodiment, an award may be issued based on the game fee and the non-gambling game outcome.

DESCRIPTION

Figure 1:
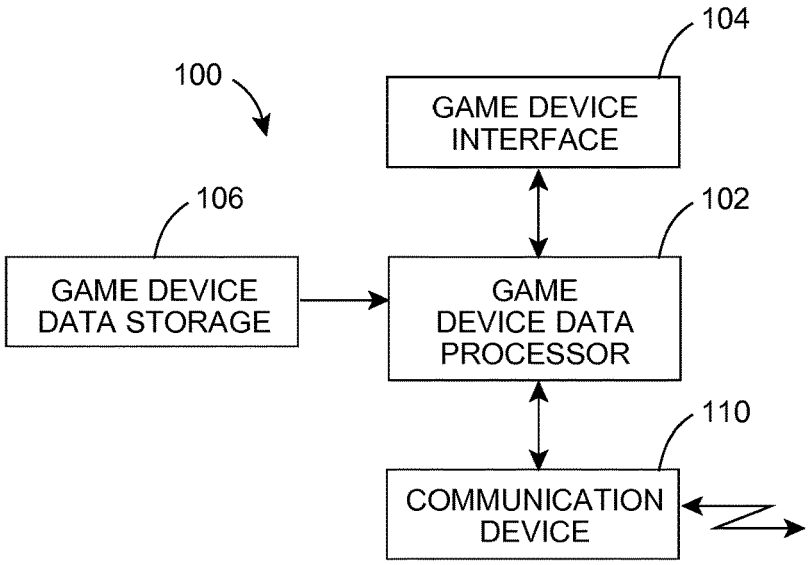
FIG. 1 is a block diagram of a game device according to an embodiment of the present invention.

Reference is now made to the figures wherein like parts are referred to by like numerals throughout. Referring to FIGS. 1-4, an embodiment of the present invention includes a system and method for linking activity in a non-gambling game to the triggering of a gambling game.

An embodiment of the present invention may be applied to any non-gambling game and a different, logically independent, gambling game. That is, embodiments of the present invention described herein are not dependent on the specific non-gambling game and gambling game(s) involved. Thus, the non-gambling game may take any form including pay-to-play, free-to-play, free-to-download, fee-to-download, or any combination thereof. Similarly, the gambling game may be conducted in any format. For example, in various optional embodiments, the present method may be applied to any wagering game in which a wager is staked for a chance to win an award whether that wager is in the form of real money, game credits, subscription fees, or the like.

In an optional embodiment, the non-gambling game is a game in which no wager is staked although, as previously noted, it is contemplated that the non-wagering game may be free, require a subscription or fee, or require other consideration for play (e.g., joining a loyalty program, submitting data used for marketing, making a purchase, or the like). It is also noted that although no wager is staked in the non-wagering game, it is contemplated that prizes, whether tangible (such as a good, service, currency, or the like) or promotional (discounts, play currency, or the like) in nature may be offered as awards in the non-wagering game. Additionally, the non-wagering game may include a virtual economy in which real or virtual money can be used or exchanged for in-game thematic or game play elements. For example, role playing games such as World of Warcraft™ and Club Penguin™ have virtual economies in which in-game thematic or game play elements can be purchased by a user using in-game credits.

In the examples below, the non-gambling game may take the form of a game, puzzle, quiz, or other activity. For example, the non-gambling game may be a puzzle (such as a jigsaw puzzle, crossword puzzle, chess puzzle, or the like), magic number square (such as Sudoku), arcade or video game (such as Call of Duty™), social game (such as Farmville™), role playing game (such as World of Warcraft™), trivia game, or the like.

The non-gambling game includes one or more transition points in the game play. It is noted that, as used herein, a transition point is not necessarily tied to the end of the non-gambling game. Rather, it is contemplated that a transition point may occur at any time during the non-gambling game, including at any point at the beginning, middle, or end of the non-gambling game. It is also contemplated that multiple non-gambling games, or multiple levels within a non-gambling game, may be required to reach a transition point. For example, a transition point may be reached by a player striking a specified target in three consecutive non-gambling games, successfully completing five levels in a non-gambling games, finding a specified number of items over one or more non-gambling game levels, or the like. Similarly, it is contemplated that a non-gambling game may have multiple transition points. In an optional embodiment, the non-gambling game may take the form of a software application that is executed and displayed on a game device 100. Alternatively, the non-gambling game may take the form of a software application that is stored on a server 200 and executed and/or displayed remotely at a game device 100.

A game device 100 may take any form, including a mobile telephone, tablet device, personal digital assistant ("PDA"), personal computer, kiosk, arcade game machine, game console, handheld device, electronic gaming machine, interactive television, or any other electronic device. In one such optional embodiment, a game device 100 includes a game device data processor 102 in communication with a game device interface 104 and a game device data storage 106. In an optional embodiment, the game device interface 104 includes an output device, such as a display, and an input device. Optionally, the output device and input device may be combined, such as in a touch screen. In an optional embodiment, the game device 100 may include a communication device 108, that includes at least a transmitter and/or a receiver.

The form of the game device 100 may vary depending on the implementation. In this regard, a system according to some embodiments of the present invention may include a plurality of game devices 100 in mixed forms. Although the examples below give examples of game devices 100 as primarily casino devices, such as electronic gaming machines, live and electronic gaming tables, electronic and mechanical slot machines, or the like, it is contemplated that many different forms or combinations of forms of game devices 100 may be included within a system, such as mobile phones, tablets, personal computers, or the like.

In one optional embodiment, the game device data processor 102 may take any form, including a conventional microprocessor. In optional embodiments, a game device data processor 102 may include a random number generator in the form of hardware or firmware, or may execute a random number generator in the form of software. In such an optional embodiment in which a game device data processor 102 uses a random number generator, it is contemplated that the random number generator may, at least in part, generate a number in random or quasi-random fashion which, in turn, may be used, at least in part, to produce a random gambling game outcome. In an alternate optional embodiment, a system may include a server 200 which contains a random number generator in the form of hardware or firmware, or executes a random number generator program in the form of software. The server 200 communicates the randomly generated number, or the random gambling game outcome mapped to the randomly generated number, to the game device 100 for display thereon.

In an optional embodiment, the game device interface 104 may include a display, including a cathode ray tube ("CRT") monitor, liquid crystal display ("LCD"), organic light emitting diode ("OLED") display, plasma display, television, or the like. The game device data processor 102 may communicate directly or indirectly, such as through a video controller or video card, with the display.

In an optional embodiment, the game device interface 104 may include an input device to receive input from a user and transmit it to the game device data processor 102. Such an input device may take any form, such as mouse, pointer, keyboard, keypad, button panel, stylus, voice recognition hardware or software, handwriting recognition hardware or software, or the like. In an optional embodiment, the input device may be integrated with a display in a touch screen device.

In an optional embodiment, a game device interface 104 may also include a device to receive wagers and/or purchases of game credits. For example, a game device interface 104 and/or game device interface 204 may include a ticket or voucher reader, bill acceptor, coin receiver, magnetic-stripe card reader, smart card reader, bar code scanner, radio frequency identification ("RFID") transceiver, radio wave receiver, transmitter, and/or transceiver (such as WiFi™, Bluetooth™, cellular, or the like), or other device. The game device interface 104 may also include an output device to output currency or representations of currency for awards, cash out requests, or the like. For example, the output device could include a ticket or voucher printer, bill or coin dispenser, card encoder, bar code printer, RFID transceiver, radio wave receiver, transmitter, and/or transceiver, or the like. It is noted that, in an optional embodiment, devices may perform multiple functions, such as reading tickets or vouchers and accepting bills.

Figure 2:
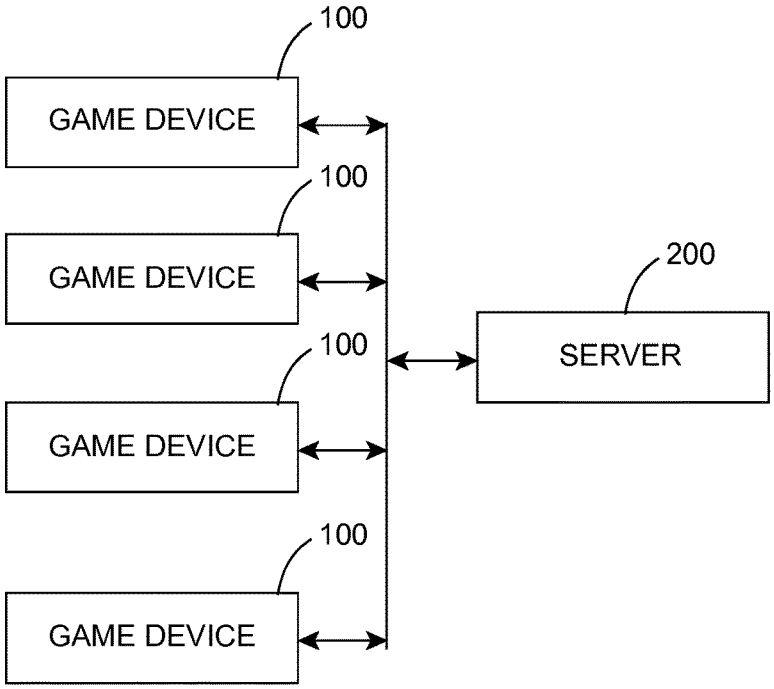
FIG. 2 is a block diagram of a system according to an embodiment of the present invention.
Figure 3:
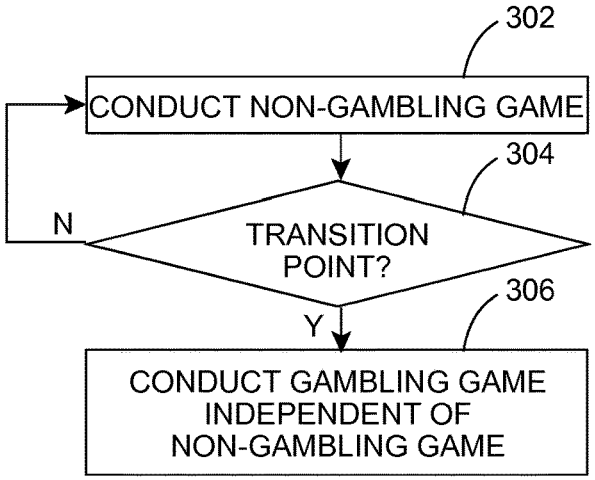
FIG. 3 is a flowchart of a method according to an embodiment of the present invention.
Figure 4:
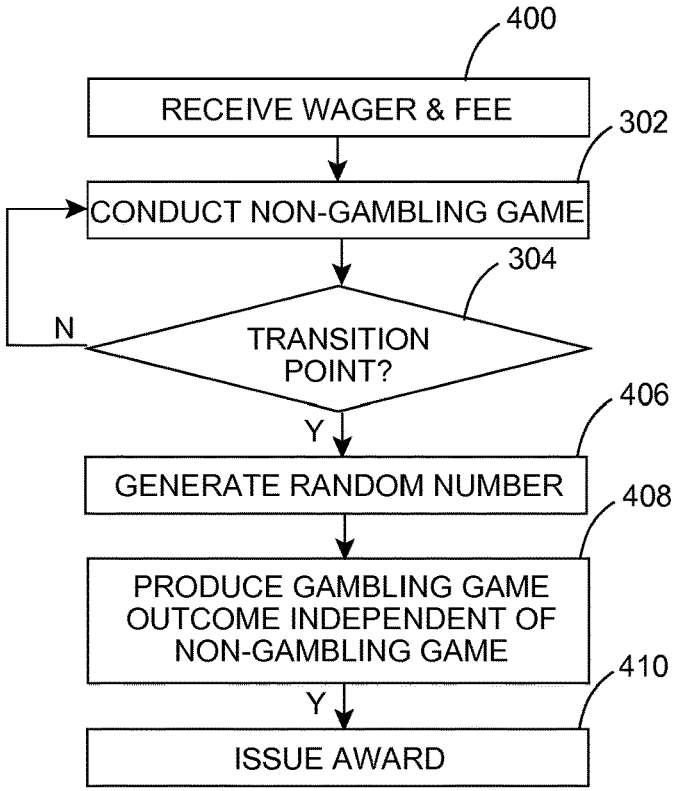
FIG. 4 is a flowchart of a method according to an embodiment of the present invention.

A communication device 110 may take any form, including a modem, wired or wireless network interface card ("NIC"), or the like. Likewise, a communication device may use any communication method including wired or wireless signals, radio waves, light, laser, sound, image, or the like, and may communicate using any protocol, including TCP/IP, serial communication, cellular, Bluetooth™, or the like. As illustrated in FIG. 2, a system may include a server 200 which is in communication with the game device 100. In such an optional embodiment, the server 200 may communicate with the game device 100 via a communication device 110 at the game device. It is contemplated that the server 200 may store and execute software to produce displays at the game device 100, including by operating a random number generator at the server 200 to thereby remove the necessity for the game device 100 to include a random number generator. As may be understood, the server 200 may also serve to provide additional processing capacity, storage, tracking, and display for information received from game devices 100, and may likewise provide a pathway for communication among multiple networked game devices 100.

In an optional embodiment, game device data storage 106 may take any form including magnetic storage, optical storage, flash storage, or the like. A game device data storage device 106 may store executable program instructions executable by the game device data processors 102. For example, a game device data storage 106 may store executable program instructions to conduct a non-gambling game, along with graphics, sounds, social media content, and game parameters for conducting the non-gambling game. Likewise, a game device data storage 106 may store executable program instructions to conduct a gambling game, along with graphics, sounds, pay tables, and game parameters for conducting the gambling game. As suggested above, in an optional embodiment a game device data storage device 106 may also store executable program instructions to generate a random number. As may be appreciated, the use of a random number combined with an interface that receives wagers and issues pay outs would satisfy most legal definitions of a wagering game, game device, gambling device, or similar term.

It is contemplated that the game device data storage device 106 may be local to the game device 100 or remote from the game device 100. For example, in one optional embodiment, game applications for either or both of the non-gambling game and/or the gambling game may be executed from a "cloud" of remote data storage devices 106 in communication with the game device 100 via a network or other means of communication. It is contemplated that the game device 100 may, in such a cloud embodiment, communicate with the application layer storing the non-gambling game and/or game on a continuous or periodic basis. That is, a game device 100 may execute a non-gambling game and/or gambling game by maintaining a continuous connection to the application layer of a cloud such that the non-gambling game and/or gambling game are not stored locally at a game device 100. Alternatively, a game device 100, game device 100, or both may download from the application layer of a cloud some or all of the files necessary to execute a non-gambling game and/or game such that the non-gambling game and/or game are executed at least partially in a local computing environment.

As noted above, in an optional embodiment, a system may include a server 200. It is noted that inclusion of a server 200 is entirely optional, as certain optional embodiments omit a server 200 and certain functions within a system including a server 200 would not require use of a server 200. In those embodiments utilizing a server 200, the server 200 may be configured to perform many different functions, including providing an interface, or interfacing, with a website, such as a social media website, to display and provide access to data and information gathered (whether automatically or upon receipt of a user command) from a game device 100. A server 200 may also provide tracking and reward functions by storing information gathered from, or input by users at, a game device 100. In one such optional embodiment, a server may be configured to store user tracking records that store data representing each user's use of a game device 100. It is contemplated that other activity may be tracked as well. For example, the tracking performed by the server 200 may be integrated with other forms of purchase tracking, activity tracking, or the like. For example, where the game device 100 is an electronic gaming machine, activity may be tracked for a user's activity at the gaming machine for purposes of rating the player in a player loyalty/reward program. In one such optional embodiment, a server 200 may perform player loyalty and/or player reward functions in which player units (sometimes referred to as "player points"), may be awarded based on the user activity tracked at the game device 100 in either or both of the non-gambling game and the gambling game.

In an optional embodiment, a server 200 may also perform financial functions. For example, in an optional embodiment, the server 200 may process, or communicate with a device that processes, financial information for the purpose of performing purchases, wagers, or the like.

Referring to FIGS. 1-4, in some embodiments, the present invention includes a method in which activity at a game device 100 during the conduct of a non-gambling game may result in a transition point which triggers a gambling game at the game device 100. Generally stated, the conduct of a non-gambling game includes player input. In an optional embodiment, the player input requires some skill, such as striking a target. Based on the player input, a determination is made whether a transition point has been reached in the non-gambling game. If a transition point has occurred, a gambling game is conducted and a gambling game outcome is generated. The gambling game outcome is entirely dependent on a random number generator and entirely independent of the non-gambling game. Understood in this manner, the non-gambling game is simply a stage that triggers the gambling game, without influencing or interacting with the gambling game.

Specifically, a game device 100 is configured to execute a non-gambling game. For example, the game device 100 may be an electronic gaming machine, and a non-gambling game may be software installed on the game device 100. In various optional embodiments, the non-gambling game may include a fee or may be free, but in either case, would not require a wager. However, in such an optional embodiment, it is contemplated that a fee for the non-gambling may be collected along with a wager for the gambling game (as described in greater detail below), although the fee and wager may be handled separately.

The non-gambling game is conducted 302 for a user at the game device 100. As noted above, the non-gambling game may be skill-based, chance-based, or a combination thereof. In an optional embodiment, the non-gambling game may be skill-based or predominated by skill and conduct of the game may include receipt of skill-based player input at the game device 100. As discussed above, the non-gambling game may include video games, puzzles, trivia, or other forms of skill-based games.

The non-gambling game includes at least one transition point. In conducting the non-gambling game, the game device 100 determines whether a transition point has been reached. As noted above, the transition point may take any form. For example, the transition point may be reached by performing a task within the non-gambling game, reaching a goal within the non-gambling game, or otherwise achieving some level of performance within the non-gambling game. In a further or alternative optional embodiment, transition points (or the opportunity to reach a transition point) may be obtained, at least in part, randomly. For example, within a video game, a transition point may include finding and obtaining a dynamic item that appears sometimes, but not all the time, with the appearance of the item determined by chance.

It is contemplated that, while the non-gambling game may include some elements of skill to play the game, the process of reaching transition points may be defined to include no skill at all. That is, any skill required to progress through the non-gambling game may be separate from the process of reaching transition points which, in one optional embodiment, requires no skill at all. For example, in an optional embodiment in which the non-gambling game is a shooting game, the transition point may be reached by merely pulling a trigger, regardless of whether a designated target within the non-gambling game is struck. In such an example, the trigger can be viewed as replacing the handle or "spin" button on a traditional reel slot machine. In such an optional embodiment, faster trigger pulls would merely cause the non-gambling game to reach transition points faster and result in faster gambling, i.e., each trigger pull would result in the placement of a wager, display of an event in the non-gambling game, conduct of the gambling game, and resolution of the wager.

In another optional embodiment, the skill of the player may be negated by altering the transition point to accommodate the player. For example, in an optional embodiment directed to a non-gambling game which is a shooting game, the area for which a "hit" is registered in the non-gambling game, thereby triggering a transition point which causes the gambling game to be conducted, may grow when one or more "misses" occur so that a "hit" becomes more likely. In an optional embodiment, such a process may be repeated so that the target area occupies the entire display, thereby guaranteeing a "hit" which, in turn, guarantees that a transition point will be reached regardless of the player's skill level.

It is contemplated that, in an optional embodiment, a non-gambling game may include solo transition points, group transition points, or both solo and group transition points. Thus, in one optional embodiment, the non-gambling game is a multi-player game. In optional embodiments in which the non-gambling game is a multi-player game, the players may cooperate, compete, or a combination thereof to reach transition points. In one such optional embodiment, transition points may require the assistance or participation by other users. For example, in an optional embodiment, the non-gambling game is a social game in which at least a portion of the game play includes social interaction with other users. In one such optional embodiment, the assistance of, or participation by, other users is required to reach the transition point. For example, different players may be provided with different tools or weapons, and a transition point may only be reached by forming a team with all the required tools or weapons to bypass the obstacles blocking the pathway to the transition point.

In an additional or alternate optional embodiment, players may compete against one another to reach transition points. For example, in one optional embodiment, players may challenge one another. The result of the challenge may constitute or relate to a player reaching a transition point, e.g., a transition point may be reached when a player wins (or loses) a predetermined type or quantity of challenges.

In an additional or alternate optional embodiment, players may cooperate. In one such optional embodiment, one or more transition points may be tasks that can only be performed when two or more players in the multi-player game cooperate, e.g., at least some transition points may be impossible to reach without the cooperation, communication, assistance, or other participation of another player in the non-gambling game. Such cooperative participation may be simultaneous, e.g., such as a task of reaching an object that cannot be reached by either player alone, sequential, e.g., such as a task of one player finding an object then telling another player how to retrieve it, a combination of simultaneous and sequential cooperation, or time-independent.

In a further optional embodiment, the task may require cooperative, yet competitive, participation by multiple players. For example, a task of demolishing a building may require multiple players to accomplish, but if only one of the players may reach the transition point, the players may complete, for example, to fire the final shot that demolishes the building.

In yet a further optional embodiment, a task may require cooperation, but the cooperation may not necessarily be coordinated. For example, a task may require players to solve a puzzle with separate players solving separate pieces of the puzzle so that a player is only responsible for his or her puzzle segment and is neither helped nor hindered by other players. It is noted that in such an optional embodiment, time may not be a factor insofar as the puzzle segments may occur simultaneously, sequentially, or independent of time (e.g., each player solves a segment as it is encountered in the game).

It is contemplated that reaching a transition point is not necessarily a final outcome. Rather, a transition point could occur during a non-gambling game. Additionally, a transition point is not necessarily a "winning" outcome or a "losing" outcome, although it could be tied to either a winning outcome or a losing outcome, and may be independent of winning or losing the non-gambling game. For example, a user may reach a transition point for completing a task or finding an item within a non-gambling game, regardless of whether the end result of the non-gambling game is a "win" or a "loss." In another optional embodiment, the transition point may be specifically tied to one or more wins or losses.

When a transition point is reached 304 during the non-gambling game, a gambling game is triggered. In one optional embodiment, the gambling game is triggered immediately at the same game device 100.

In an alternate or additional embodiment, the gambling game is triggered for play at a different game device 100 or at a different time. In one such optional embodiment, a server 200 may store the fact of the triggering of the gambling game. By "storing" the fact that the transition point was reached, and a gambling game has been triggered, it is contemplated that a server 200 may store data in a database of users and/or game devices 100 that associates the user and/or game device 100 with the transition point and/or data representing the transition point. In one such optional embodiment, a database may identify users and/or game devices 100 in any manner, including by user name, device number (such as mobile telephone number, IMEI number, IMSI number, MAC or network address, or the like), IP address, account number, social media account, or other identifier. When a game device 100 receives input identifying a record at the database stored at the server, the gambling games that have been triggered for play at the game device 100 may be determined from the database.

A game device 100 conducts 306 a gambling game in response to reaching a transition point in a non-gambling game. In an optional embodiment, the game device 100 conducting the gambling game is a casino game device, such as an electronic gaming machine, electronic table game, or the like.

In one optional embodiment, a single game device 100 conducts the non-gambling game and gambling game. In another optional embodiment, separate game devices 100 conduct the non-gambling game and the gambling game. For example, in one optional embodiment, the game device 100 conducting the non-gambling game is an arcade game and the game device 100 conducting the gambling game is an electronic gaming machine, electronic table game, or the like.

When the non-gambling game and gambling game are conducted on separate game devices 100, a game device 100 conducting the non-gambling game may communicate with a server 200. More specifically, the server 200 receives communication from the game device 100 conducting the non-gambling game identifying a transition point that was reached at the game device 100. The server 200 may then make that available to a game device 100 configured to conducting a gambling game, such that the server 200 acts somewhat as an intermediary between game devices 100. It is contemplated that the transfer may occur more or less in real time, or the transfer may be delayed, with the server 200 storing the data identifying the transition point for at least some time.

In one example, a server 200 may be part of, or configured for communication with, a player tracking and/or player loyalty system operating in connection with one or more game operators. In some such embodiments, a server 200 or game device 100 may utilize the player database to store records of a transition points reached during non-gambling games. The transition point may be accessed by the user at a game device 100 in communication with the player tracking and/or player loyalty system. For example, in one optional embodiment, the user identifies himself or herself at the game device 100 using an encoded card, personal identification number ("PIN"), user number or identifier, radio frequency identification ("RFID") transponder, mobile device, or other means for identifying and/or authenticating the user to the game device 100. After being identified, the gambling game triggered by the transition point may be conducted for the player at the game device 100.

In another example, a server 200 is part of, or configured for communication with, a social network site. In some such optional embodiments, a server 200 utilizes the user database to store records of a transition points in the social network profile for the user. The transition point may be accessed at a game device 100 which communicates with the social network. For example, the game device 100 may communicate via the world wide web, virtual private network ("VPN"), local area network ("LAN"), wide area network ("WAN"), mobile broadband, WiFi, or the like with the social network. Optionally, the user's identity is also transmitted, such as through a username and password, biometrics, caller ID, automatic number identification ("ANI"), account number, IP address, or other identifying data, to access the correct profile on the social network. After being identified, the gambling game triggered by the transition point may be conducted for the player at the game device 100.

The game device 100 conducts the gambling game. In an optional embodiment, the gambling game conducted is logically independent of the non-gambling game. That is, in such an optional embodiment, the outcome of the gambling game is entirely determined based on a random number generated during the gambling game, and is entirely independent of the conduct of the non-gambling game.

For example, the gambling game may be a wagering game of any format, such as a reel slot game, live or electronic card game, video poker game, blackjack game, roulette game, keno or other numbers game, baccarat game, lottery game, pull-tab game, or any other game in which a mandatory wager is received 400 from a user (such as through a game device interface 202), with the wager staked on the gambling game outcome. When the gambling game is conducted, it is conducted solely based on the rules of the gambling game and a randomly generated number 406, as if the sole role of the non-gambling game was to trigger the game with no interaction between the non-gambling game and gambling game. Thus, the gambling game outcome is determined 408 solely based on the random number generator.

More specifically, the wager staked on the gambling game is resolved based on the gambling game outcome. In one such optional embodiment, the gambling game is determined entirely or predominantly based on chance, e.g., a random event, and results in either a loss, in which case the wager is collected, or a win, in which case a payout is issued 410. Certain gambling games may also include pushes or ties, in which case the wager is returned.

The gambling game may be presented at a display. For example, striking a specified target may be a transition point, which causes the game device 100 to generate and display a reel slot game that was triggered by the transition point. The outcome of the gambling game may then be generated (again, independent of the non-gambling game and based solely on a randomly generated number) and displayed in the form of reel slot symbols lying along pay lines. It is contemplated that the gambling game of such an optional embodiment may replace the display of the non-gambling game (e.g., the non-gambling game is paused while the gambling game supplants the non-gambling game at the display), or the gambling game may be displayed on a secondary display at the game device 100 (e.g., the game device 100 includes two separate displays, one of which shows the non-gambling game while the other shows the gambling game), or the gambling game may be displayed in a window on the same display as the non-gambling game (e.g., the game device 100 include a single display, which shows the non-gambling game and gambling game in separate windows).

Alternatively, the gambling game may not be displayed at the game device 100. Rather, striking a specified target may be a transition point which causes the game device 100 to conduct a reel slot game internally, with only the gambling game outcome displayed in the form of the award for the wager. As may be appreciated, such an optional embodiment would provide the illusion that striking the specified target resulted in an award, while in reality, striking the specified target triggered a gambling game which resulted in an award.

It should be further noted that a transition point may lead to different gambling games depending on the non-gambling game in which the transition point is received. For example, certain non-gambling games may be associated with gambling games with a higher hit frequency, but lower pay outs, while other non-gambling games may be associated with gambling games with a lower hit frequency, but higher pay outs.

Additionally, the nature of the pay outs and awards may be structured so that the game device 100 always returns something, although this may be achieved by how the fees and wagers are handled. For example, in an optional embodiment, the game device 100 may always return the fee (or a portion of the fee) associated with the non-gambling game, while any payout associated with the wager is determined by the gambling game. Thus, in such an optional embodiment, the game device 100 would also return something.

For example, a game device 100 may receive $5.00, with $1.00 allocated to a fee for the non-gambling game and $4.00 allocated to a wager on the gambling game. When a transition point is reached in the non-gambling game, a gambling game is conducted with $4.00 staked on the outcome. If the outcome of the gambling game is a losing outcome, the payout would be $0.00 from the gambling game. However, if the $1.00 fee was allocated with $0.50 allocated to a retained fee and $0.50 to a return fee, the game device 100 would issue a total payout of $0.50. Thus, $4.00 was lost on the gambling game, $0.50 was assessed as a fee for the non-gambling game, and $0.50 was returned to the player. Alternatively, if the gambling game resulted in an outcome associated with a payout of three times the wager, the payout from the gambling game would be $12.00. Again, if the $1.00 fee was allocated with $0.50 to a retained fee and $0.50 to a return fee, the game device would award a total payout of $12.50 (e.g., $12.00 won from the gambling game plus $0.50 returned from the non-gambling game, with $0.50 assessed as a fee for the non-gambling game). In an optional embodiment, the entire fee could be returnable, with no retained fee for the non-gambling game. Thus, in the example above, conduct of the game may always result in a return of at least $1.00, with any additional return being based on a $4.00 wager on the gambling game. Such a system would provide a game that always pays something.

It should be noted that, in an optional embodiment, the non-gambling game only affects the display the gambling game, without affecting the conduct or structure of the underlying game. For example, in an optional embodiment, the non-gambling game (or the player input received during the non-gambling game) may not affect the odds of winning the game, the pay out, the payback percentage, the hold, the expected value or return, or other metric by which the game is measured.

In an optional embodiment, the user may be permitted to input an election regarding the triggering of a gambling game upon reaching a transition point. For example, in an optional embodiment, the game device 100 may receive input to select the specific non-gambling game to conduct upon reaching a transition point. Thus, in one such optional embodiment, a game device 100 may generate a menu of gambling game selections at a transition point and receive input selecting one or more of the gambling games presented in the menu. The game device 100 then conducts the gambling game(s) in response to the selection received.

Notwithstanding the foregoing, it is also contemplated that, in an optional embodiment, the user may not be provided with any selection regarding the triggering of a gambling game upon reaching a transition point. For example, the gambling game may be immediately conducted at the game device 100, without any selection from the user, with the gambling game either displayed or hidden from the player. In an optional embodiment in which the gambling game is hidden from the player, the illusion would be created that the non-gambling game is conducted without interruption, with payouts being received at the various transition points seamlessly and automatically.

It is also contemplated that the user may, or may not, be informed of the location or results that occur in the gambling game at any specific transition points. Rather, a player may play an entire level, passing through one or more transition points at which gambling games occurred outside the view of the player, with the overall outcome only displayed at the end of the level. For example, $20.00 may be received for a non-gambling game that includes three transition points, with $5.00 wagered on each gambling game triggered at the three transition points and $5.00 received as a return fee. As the non-gambling game is conducted, the transition points are encountered (such as by hitting specified targets) and gambling games are conducted to produce a gambling game outcome at teach transition point. In one example embodiment, the results are not provided at each transition point, but rather presented at the end of the level. Thus, in one example, the end of the level may end in an award of $15.00 from the initial $20.00. Again, outwardly, it would appear to the player that he or she won $15.00 for playing a level of the non-gambling game. However, internally, the game device 100 would have conducted three gambling games, each based on a $5.00 wager, with two gambling games resulting in losses and one gambling game resulting in a $10.00 payout. Combining the $10.00 payout with the $5.00 return fee, an overall award of $15.00 would be paid.

It should be noted that an a non-gambling game may be configured with transition points with the non-gambling game having a defined end or an indefinite end. For example, a non-gambling game may be conducted in discrete segments, such as levels, with each segment requiring a predefined amount of fees plus wagers. Alternatively, a non-gambling game may be conducted in an open-ended manner, with the non-gambling game continuing until the deposited fees plus wagers are exhausted.

In an optional embodiment, the non-gambling game may include multiple transition points. The multiple transition points may be fixed or random. For example, a non-gambling game may include shooting a set of targets, a fixed number of which are transition points that trigger a gambling game. In another example, a non-gambling game may include shooting a set of targets, a random number of which are transition points that trigger a gambling game.

In an optional embodiment, the gambling game may relate to the transition point. For example, the gambling game associated with a small target may have a higher pay table or greater hit frequency than the gambling game associated with a large target. Thus, although input in the non-gambling game does not affect the conduct of the gambling game, input in the non-gambling game may determine which gambling game is conducted.

It should also be noted that the order of the gambling game and non-gambling game may be reversed. For example, in one optional embodiment, a gambling game may precede the non-gambling game, with the non-gambling game being conducted in response to the generation of a gambling game outcome.

While certain embodiments of the present invention have been shown and described it is to be understood that the embodiments of present invention shown and described are subject to many modifications and changes without departing from the spirit and scope of the invention presented herein.

We claim:

1. An electronic game machine, comprising:

a non-transitory computer readable medium including program instructions;

a game device interface configured and arranged to detect an input associated with a monetary value;

a game device controller in communication with said game device interface, the non-transitory computer readable medium, and at least one of a software and hardware-based random number generator, wherein said game device controller is configured to communicate to a game device display of the game device interface, and is operative to execute the program instructions comprising:

receiving a wager and a game fee through said game device interface from the input, the game fee being greater than zero;

conducting a first game by said game device controller, wherein said first game includes data identifying at least one transition point which is reached, at least in part, in response to receiving at least one skill-based player input data through said game device interface, the data identifying the at least one transition point being stored on a server coupled to the electronic game machine, and optionally at least one other electronic game machine;

generating a first game outcome based, at least in part, on said skill-based player input data; and conducting a second game, which is logically independent of said first game, by said game device controller solely in response to said first game reaching said data identifying the transition point, wherein said second game utilizes said random number generator module to generate a gambling game outcome independent of the first game and said at least one skill-based player input data;

determining by said game device controller whether said second game outcome is a winning outcome;

issuing a payout based on said wager through a payout device of said game device interface when said second game outcome is a winning outcome independent of the conduct of said first game; and independent of the outcome of the first game and/or the second game, returning at least a portion of the game fee.

2. The electronic game machine of claim 1 wherein said step of determining whether said second game outcome is a winning outcome comprises comparing said second game outcome to a predefined schedule of winning outcomes by said game device controller.

3. The electronic game machine of claim 1 wherein said program instructions further comprise conducting said first game in response to receipt of said game fee and returning at least a portion of said game fee at said transition point.

4. The electronic game machine of claim 3 wherein said program instructions further comprise:

issuing an award based on said game fee and said first game outcome.

5. The electronic game machine of claim 1, wherein said program instructions further comprise:

displaying said first game at said game device display while conducting said first game; and conducting said second game without displaying said second game at said game device display.

6. The electronic game machine of claim 3 wherein said program instructions further comprise returning at least a portion of said game fee at said transition point based at least in part on said first game outcome.

7. The electronic game machine of claim 1, wherein the first game comprises a non-gambling type game and the second game comprises a gambling type game.

8. The electronic game machine of claim 1, wherein the game device interface comprises at least one of a ticket or voucher reader, personal identification number, bill acceptor, coin receiver, magnetic-stripe card reader, smart card reader, bar code scanner, radio frequency identification ("RFID") transceiver, radio wave receiver, transmitter, and a transceiver.

9. The system of claim 1, wherein the input comprises a physical item associated with a monetary value, the monetary value including the wager and the game fee.

10. The system of claim 1, wherein the wager and game fee enter the game device interface as combined monetary value, wherein at least a portion of the monetary value is used for the first game and another portion is used for the second game, and at least some further portion is returned to the player as a portion of the game fee.

11. The system of claim 1, wherein the input comprises at least one of money or currency, game credits, subscription fees, and monetary value received from at least one of a ticket or voucher reader, a bill acceptor, a personal identification number, a coin receiver, a magnetic-stripe card reader, a smart card reader, a bar code scanner, a radio frequency identification ("RFID") transceiver, a radio wave receiver, a transmitter, and/or transceiver.

12. An electronic game machine, comprising:

a non-transitory computer readable medium including program instructions;

a game device interface configured and arranged to detect an input associated with a monetary value;

a game device controller in communication with said non-transitory computer readable medium, game device interface, and at least one of a software and hardware-based random number generator, wherein said game device controller is operative to execute the program instructions comprising:

receiving a wager through said game device interface by detection of the input;

conducting a second game by said game device controller, wherein said second game utilizes said random number generator to generate a second game outcome;

receiving a game fee greater than zero through said game device interface;

conducting a first game, which is logically independent of said second game, by said game device controller, wherein said second game is conducted in response to said first game outcome being generated, and wherein said first game is conducted, at least in part, in response to receiving at least one skill-based player input data through said game device interface, wherein said second game outcome is generated independent of the first game and said at least one skill-based player input data;

generating a first game outcome based, at least in part, on said skill-based player input data;

determining by said game device controller, whether said second game outcome is a winning outcome;

issuing a payout based on said wager through a payout device of said game device interface when said second game outcome is a winning outcome independent of the conduct of said first game; and independent of the outcome of the first game and/or the second game, returning at least a portion of the game fee.

13. The electronic game machine of claim 12 wherein said step of determining whether said second game outcome is a winning outcome comprises comparing said second game outcome to a predefined schedule of winning outcomes by said game device controller.

14. The electronic game machine of claim 12 wherein said program instructions further comprise conducting said first game in response to receipt of said game fee and returning at least a portion of said game fee at a transition point of the first game.

15. The electronic game machine of claim 14 wherein said program instructions further comprise:

issuing an award based on said game fee and said first game outcome.

16. The electronic game machine of claim 14 wherein said program instructions further comprise returning at least a portion of said game fee at said transition point based at least in part on said first game outcome.

17. The electronic game machine of claim 12 further comprising a game device display in communication with said game device controller, wherein said program instructions further comprise:

displaying said first game at said game device display while conducting said first game; and conducting said second game without displaying said second game at said game device display.

18. The electronic game machine of claim 12, wherein the first game comprises a non-gambling type game and the second game comprises a gambling type game.

19. The electronic game machine of claim 12, wherein the game device interface comprises at least one of a ticket or voucher reader, personal identification number, bill acceptor, coin receiver, magnetic-stripe card reader, smart card reader, bar code scanner, radio frequency identification ("RFID") transceiver, radio wave receiver, transmitter, and a transceiver.

20. The system of claim 12, wherein the input comprises a physical item associated with a monetary value, the monetary value including the wager and the game fee.

21. The system of claim 12, wherein the input comprises a physical item associated with a monetary value, the monetary value including the wager and the game fee.

22. The system of claim 12, wherein the wager and game fee enter the game device interface as combined monetary value, wherein at least a portion of the monetary value is used for the first game and another portion is used for the second game, and at least some further portion is returned to the player as a portion of the game fee.

23. The system of claim 12, wherein the input comprises at least one of money or currency, game credits, subscription fees, and monetary value received from at least one of a ticket or voucher reader, a bill acceptor, a personal identification number, a coin receiver, a magnetic-stripe card reader, a smart card reader, a bar code scanner, a radio frequency identification ("RFID") transceiver, a radio wave receiver, a transmitter, and/or transceiver.

24. A system, comprising:

non-transitory computer readable medium in communication with a server; and at least one electronic game machine in communication with said server, comprising:

a game device interface configured and arranged to detect an input associated with a monetary value;

a game device controller in communication with said game device interface and at least one of a software and hardware-based random number generator, wherein said game device controller is operative to execute program instructions comprising:

receiving a wager through said game device interface by detection of the input;

receiving a game fee greater than zero through said game device interface; conducting a first game by said game device controller, wherein said first game includes data identifying at least one transition point which is reached, at least in part, in response to receiving at least one skill-based player input data through said game device interface, the data identifying the at least one transition point being stored on the server;

generating a first game outcome based, at least in part, on said skill-based player input data;

conducting a second game, which is logically independent of said first game, by said game device controller in response to said first game reaching said transition point, wherein said second game utilizes said random number generator to generate a second game outcome independent of the first game and said at least one skill-based player input data;

determining by said game device controller whether said second game outcome is a winning outcome;

issuing a payout based on said wager through a payout device of said game device interface when said second game outcome is a winning outcome independent of the conduct of said first game; and independent of the outcome of the first game and/or the second game, returning at least a portion of the game fee to the player.

25. The system of claim 24 wherein said server is operative to operate said random number generator.

26. The system of claim 24 wherein said server is operative to store said program instructions executable by said game device controller.

27. The system of claim 24 wherein said step of determining whether said second game outcome is a winning outcome comprises comparing said second game outcome to a predefined schedule of winning outcomes by said game device controller.

28. The system of claim 24 wherein said program instructions further comprise conducting said first game in response to receipt of said game fee and returning at least a portion of said game fee at said transition point.

29. The system of claim 28 wherein said program instructions further comprise:

issuing an award based on said game fee and said first game outcome.

30. The system of claim 28 wherein said program instructions further comprise returning at least a portion of said game fee at said transition point based at least in part on said first game outcome.

31. The system of claim 24 wherein said at least one electronic game machine further comprises a game device display in communication with said game device controller and wherein said program instructions further comprise:

displaying said first game at said game device display while conducting said first game; and conducting said second game without displaying said second game at said game device display.

32. The system of claim 24, wherein the first game comprises a non-gambling type game and the second game comprises a gambling type game.

33. The system of claim 24, wherein the game device interface comprises at least one of a ticket or voucher reader, personal identification number, bill acceptor, coin receiver, magnetic-stripe card reader, smart card reader, bar code scanner, radio frequency identification ("RFID") transceiver, radio wave receiver, transmitter, and a transceiver.

34. The system of claim 24, wherein the input comprises a physical item associated with a monetary value, the monetary value including the wager and the game fee.

35. The system of claim 24, wherein the input comprises a physical item associated with a monetary value, the monetary value including the wager and the game fee.

36. The system of claim 24, wherein the wager and game fee enter the game device interface as combined monetary value, wherein at least a portion of the monetary value is used for the first game and another portion is used for the second game, and at least some further portion is returned to the player as a portion of the game fee.

37. The system of claim 24, wherein the input comprises at least one of money or currency, game credits, subscription fees, and monetary value received from at least one of a ticket or voucher reader, a bill acceptor, a personal identification number, a coin receiver, a magnetic-stripe card reader, a smart card reader, a bar code scanner, a radio frequency identification ("RFID") transceiver, a radio wave receiver, a transmitter, and/or transceiver.

* * * * *